US007438383B2

(12) United States Patent
Ikeda

(10) Patent No.: US 7,438,383 B2
(45) Date of Patent: Oct. 21, 2008

(54) INKJET RECORDING APPARATUS

(75) Inventor: Yasuhiko Ikeda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 194 days.

(21) Appl. No.: 10/898,264

(22) Filed: Jul. 26, 2004

(65) Prior Publication Data

US 2005/0024425 A1 Feb. 3, 2005

(30) Foreign Application Priority Data

Jul. 30, 2003 (JP) ..... 2003-203705

(51) Int. Cl.
*B41J 2/165* (2006.01)

(52) U.S. Cl. ..... 347/33; 347/29; 347/32; 347/23

(58) Field of Classification Search ..... 347/22–24, 347/28–30, 32, 33
See application file for complete search history.

(56) References Cited

U.S. PATENT DOCUMENTS 5,508,722 A 4/1996 Saito et al.
5,663,751 A * 9/1997 Holbrook ..... 347/22
5,689,293 A * 11/1997 Hirano ..... 347/33
6,530,642 B1 3/2003 Uchikata et al.
6,616,266 B2 * 9/2003 Neal et al. ..... 347/35

* cited by examiner

*Primary Examiner*—Shih-wen Hsieh
(74) *Attorney, Agent, or Firm*—Fitzpatrick, Cella, Harper & Scinto

(57) ABSTRACT

A carriage is automatically and accurately stopped at a wiping position, so that a nozzle surface of a recording head is accurately wiped clean independently of the accuracy of the stop position of the carriage. An inkjet recording apparatus includes a wiping member for wiping clean a nozzle surface of the recording head and a carriage position control member which defines a movement range of the carriage by abutting the carriage on the carriage position control member. The wiping member wipes clean the nozzle surface while the carriage is caused to abut on the carriage position control member (that is, while a carriage motor causes the carriage to abut on the carriage position control member).

4 Claims, 12 Drawing Sheets

INKJET RECORDING APPARATUS

This application claims priority from Japanese Patent Application No. 2003-203705 filed Jul. 30, 2004, which is hereby incorporated by reference.

BACKGROUND OF THE INVENTION

1. Field of the Invention

The present invention relates to an ink-jet recording apparatus which performs recording by ejecting ink from recording means mounted on a carriage to a material to be recorded, particularly to the inkjet recording apparatus which is provided with a wiping means for wiping a nozzle surface of the recording means clean.

2. Related Background Art

In the inkjet recording apparatus, because the recording is performed by ejecting the ink from a micro nozzle toward the material to be recorded, the unnecessary ink is easy to adhere to the nozzle surface, and sometimes normal ink ejection is obstructed by the adhesion ink. Therefore, in the inkjet recording apparatus, a wiping means including a wiper blade for wiping the nozzle surface clean is provided, and the adhesion ink near the nozzle is wiped and removed in such a manner that the wiper blade and the nozzle surface are relatively moved while overlapped with each other.

A mode of the relative movement between the wiper blade and the nozzle surface includes the case in which a carriage mounting a recording head is moved with respect to the stationary wiper blade and the case in which the carriage mounting the recording head is caused to stand still to move the wiper blade in parallel with the carriage or to rotationally move the wiper blade. In most cases of the movement of the carriage, the movement of an extension of the recording movement of the carriage in a main scanning direction is utilized. In this case, the wiping is performed only when needed by taking the wiper blade in and out between an overlap position with respect to a moving path of the carriage (nozzle surface) and a retracting position. However, in the conventional configuration, it is necessary to sufficiently make a movable range of the carriage larger than a recording area, which leads to upsizing of the recording apparatus.

Recently, the nozzle surface of the recording head is often formed in a complicated concave and convex surface, so that it is harder than ever to sufficiently clean and remove dirt near the nozzle only by the wiping in the carriage movement direction in the use of the movement of the carriage. For the above-described reasons, the configuration in which the carriage is caused to stand still to move the wiper blade is often used. In the case of the movement of the wiper blade, the wiper blade is reciprocated by the parallel movement or by the rotational movement in the direction intersecting (for example, orthogonally) the direction of the main scanning movement for the recording. In this case, the carriage is stopped at a wiping position, and the wiper blade is driven to wipe the nozzle surface of the recording head clean.

However, in the above-described wiping means adopting the method of moving the wiper blade, in order to accurately wipe out a periphery of the nozzle of the recording head, it is required to stop the carriage mounting the recording head at the accurate position. Further, in order to prevent vibration during the movement of the carriage, recently a vibration dumping member is often attached between a motor used as a driving source of the carriage and the driven carriage. However, in the configuration in which the vibration dumping member is attached, due to elastic displacement in a driving mechanism, it becomes more difficult that the carriage is accurately stopped and the positioning of the carriage becomes more difficult and more inaccurate when the carriage is stopped.

SUMMARY OF THE INVENTION

It is an object of the invention to provide an inkjet recording apparatus in which the carriage can be stopped automatically and accurately at the wiping position and the wiping and cleaning of the nozzle surface of the recording means are accurately performed independently of the accuracy of the carriage stop action.

It is another object of the invention to provide an inkjet recording apparatus including a carriage which is reciprocated while mounting recording means for performing recording by ejecting ink to a material to be recorded, a position control member which defines a movement range of the carriage in such a manner that the carriage abuts on the position control member, and wiping means for wiping a nozzle surface of the recording means clean, wherein the wiping means wipes the nozzle surface clean while the carriage is abutted on the position control member.

DETAILED DESCRIPTION OF THE PREFERRED EMBODIMENTS

Figure 1:
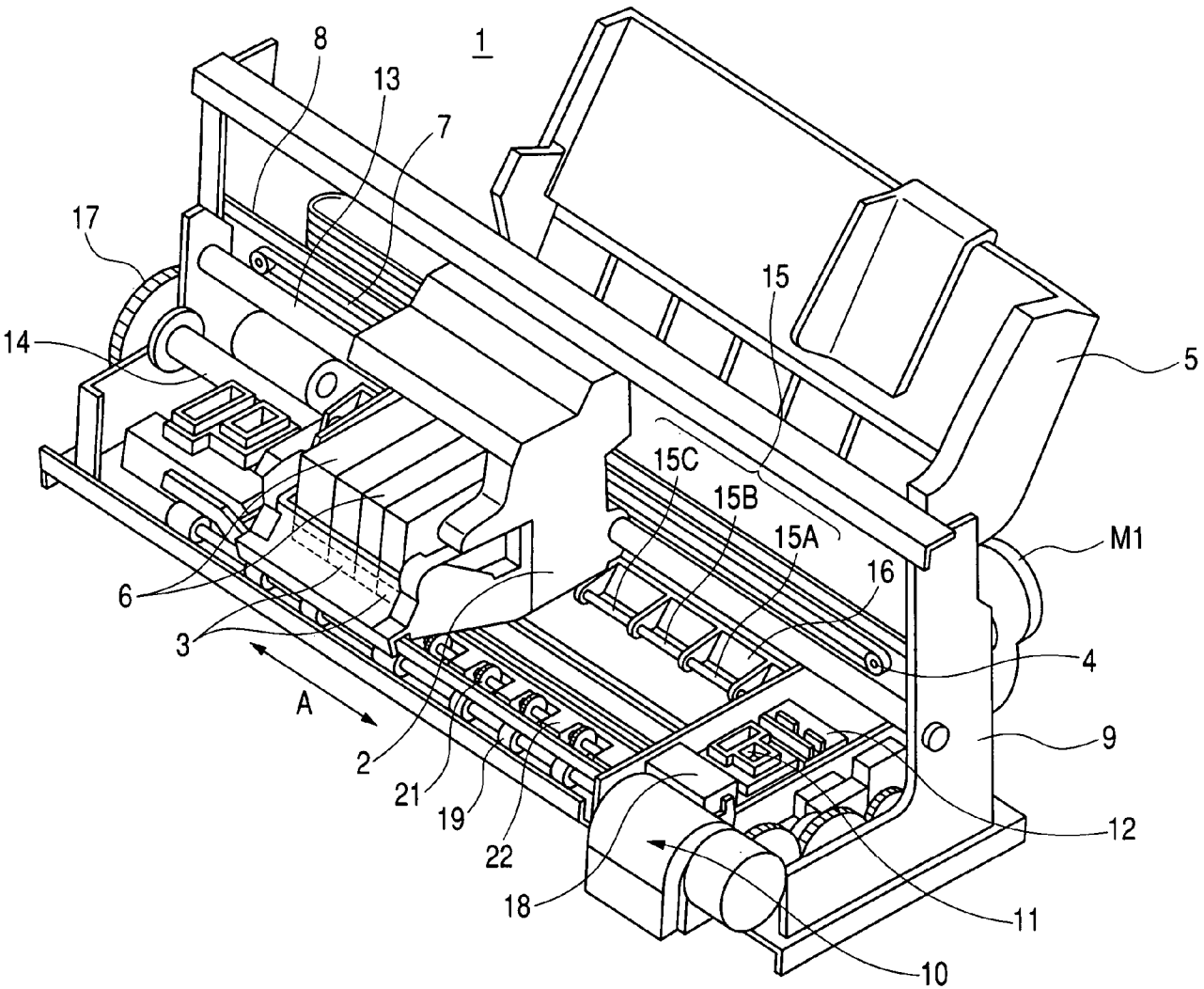
FIG. 1 is a perspective view schematically showing an example of an inkjet recording apparatus to which the invention is applied.

Referring to the accompanying drawings, preferred embodiments of the invention will be specifically described below. In the following drawings, the same reference numeral shows the same component or the equivalent component. FIG. 1 is a perspective view schematically showing an example of the inkjet recording apparatus to which the invention is applied. In FIG. 1, an inkjet recording apparatus 1 includes a carriage 2 which moves while mounting a recording head 3, a drive motor M1 and a driving mechanism 4 which reciprocate the carriage 2 in the direction of a double-headed arrow A, a paper feeding mechanism 5 which supplies the material to be recorded, and a recovery device 10 which performs ejection recovery processing of the recording head 3. These constituents are mounted on a chassis 9 which configures a main body of the apparatus.

In the inkjet recording apparatus 1, the recording is performed to the material to be recorded in a manner that the recording head 3 is driven on the basis of an image signal with the movement of the carriage 2 (main scanning) being controlled, and while conveying the material to be recorded (sub-scanning) supplied from the paper feeding mechanism 5 such as recording paper and the like. The recording head 3 and ink cartridges 6 are detachably mounted on the carriage 5. The ink stored in the ink cartridge 6 is supplied to the recording head 3. In this case, both contact surfaces of the carriage 2 and of the recording head 3 come in proper contact with each other to realize necessary electrical connection.

The recording head 3 performs the recording in such a manner that pulse voltage corresponding to a recording signal is applied to the recording head 3 to selectively eject an ink droplet from a plurality of nozzles. The recording head 3 ejects the ink droplet from the nozzle by utilizing a change in pressure caused by growth and shrinkage of a bubble in film boiling created by thermal energy applied by an electrothermal energy conversion material. The electrothermal energy conversion material is individually provided in the plurality of nozzles. When the pulse voltage is applied to the corresponding electrothermal energy conversion material in accordance with the recording signal, the ink droplet is ejected from the nozzle corresponding to the electrothermal energy conversion material.

In FIG. 1, the carriage 2 is connected to a part of a drive belt 7 of the driving mechanism 4 which transfers driving force from the drive motor M1. The carriage 2 is slidably supported while guided along a guide shaft 13 in the direction of the double-headed arrow A. The carriage 2 is driven so as to be reciprocated along the guide shaft 13 by normal rotation and reverse rotation of the drive motor M1. A code strip 8 indicating an absolute position in the movement direction of the carriage 2 is provided in the main body of the apparatus. The code strip 8 in which black bars are printed on a transparent PET film at a predetermined pitch is used in the embodiment. One end of the code strip 8 is fixed to the chassis 9 and the other end is connected to plate spring (not shown) so that tension is given.

A linear encoder (not shown) is mounted inside the carriage 2. The linear encoder reads the bar on the code strip 8, thereby the position of the carriage 2 can be accurately detected even if the inkjet recording apparatus 1 is in a recording action. When output of the signal is not changed even if the drive motor M1 is driven for a predetermined time interval, it can be detected that the carriage 2 can be moved only up to the position, i.e. it can be detected that the movement of the carriage 2 is restricted (stopped) at the position. In an initializing action of the recording apparatus 1, the carriage 2 is moved toward the internal surface on right side of the chassis 9 in FIG. 1 to abut on a carriage position control member (abutting portion) formed in the chassis 9. In this way, it is decided that the position where the carriage 2 cannot be moved by abutting on the carriage position control member is a reference position (home position) of the carriage 2. The home position becomes the reference of all the positions in the movement direction of the carriage 2 in the inkjet recording apparatus 1.

In FIG. 1, a platen (not shown) is disposed at the position opposite to a nozzle surface 23 of the recording head 3 mounted on the carriage 2. The recording is performed to the material to be recorded conveyed onto the platen in such a manner that the carriage 2 is reciprocated by the drive motor M1 and the recording signal is given to the recording head 3 to eject the ink droplet in synchronization with the movement of the carriage 2. In order to convey the medium to be recorded through a recording portion, a conveying roller 14 is driven by a drive motor M2. The reference numeral 15 designates a pinch roller which causes a recording sheet to abut on the conveying roller 14 by pressing force of a spring (not shown), and the reference numeral 16 designates a pinch roller holder which rotatably supports the pinch roller 15.

The reference numeral 17 designates a conveying roller gear fixed to one end of the conveying roller 14. The conveying roller 14 is driven by transferring driving force of the drive motor M2 to the conveying roller gear 17. The material to be recorded in which the recording has been performed is discharged outside the inkjet recording apparatus 1 by a discharge roller 19. The discharge roller 19 is driven by transferring the driving force of the drive motor M2 to a discharge roller gear (not shown). The reference numeral 21 designates a spur roller which causes the recording sheet to be pressed against the discharge roller 19 by a spring (not shown), and the reference numeral 22 designates a spur holder which rotatably supports the spur roller 21.

A recovery device 10 which maintains and recovers ink ejection performance of the recording head 3 is disposed within the movement range of the carriage 2 and at a predetermined position outside the recording area. The recovery device 10 includes capping means 11 for covering the nozzles of the recording head 3, wiping means 12 for wiping a nozzle surface 23 of the recording head 3 clean, blade cleaning means 18 for cleaning a wiper blade of the wiping means 12, and sucking means 48 having a suction pump connected to the capping means 11 (FIGS. 2 and 3) and the like.

Figure 2:
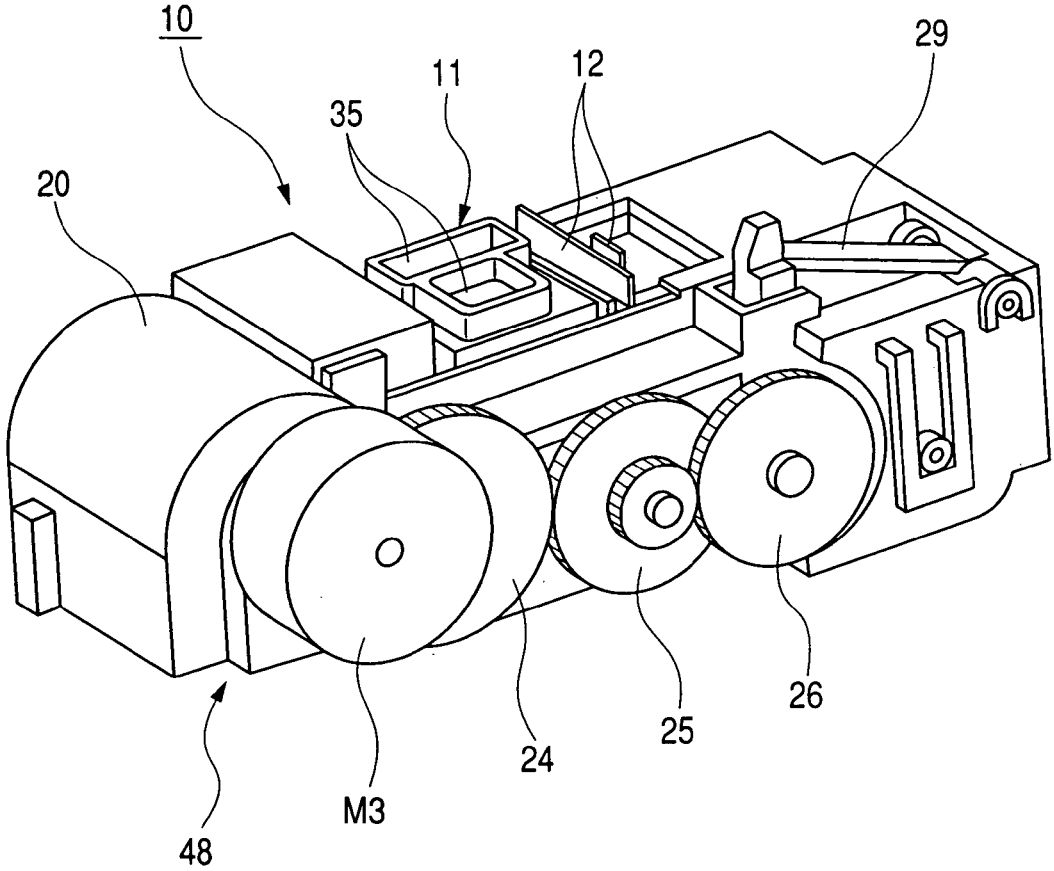
FIG. 2 is a perspective view schematically showing an example of a recovery device of the ink-jet recording apparatus of FIG. 1.
Figure 3:
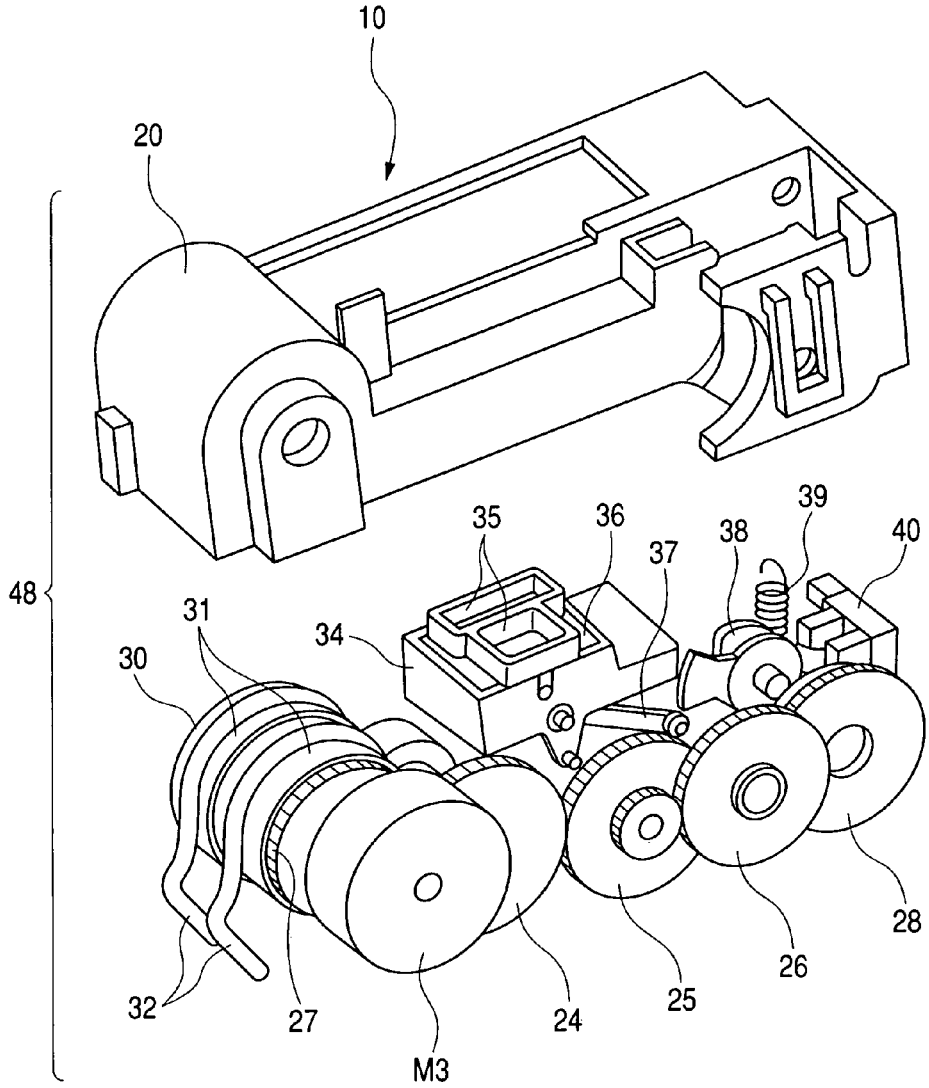
FIG. 3 is an exploded perspective view schematically showing an internal structure of the recovery device of FIG. 2.
Figure 4:
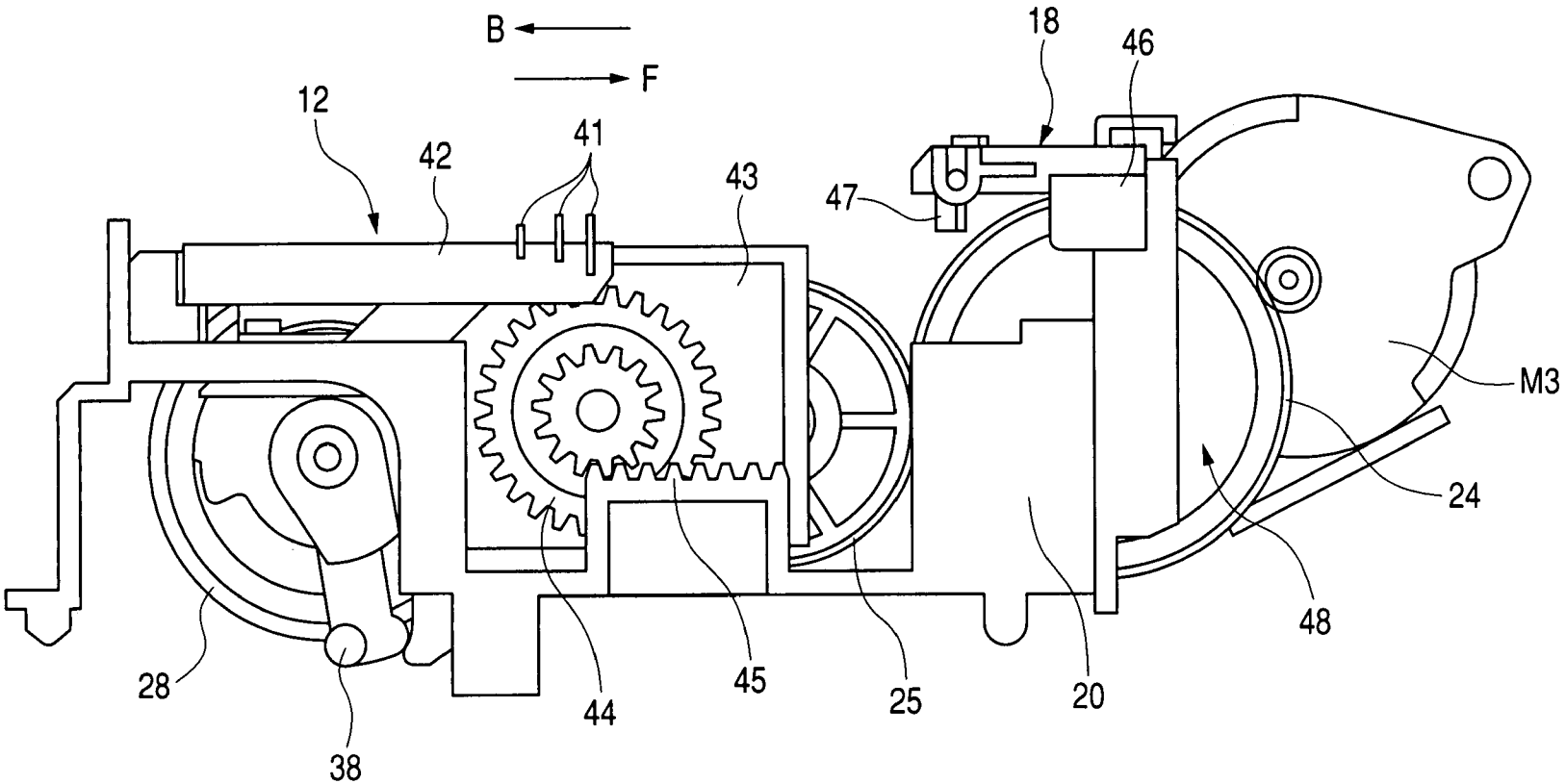
FIG. 4 is a side view schematically showing a structure of wiping means and blade cleaning means of the recovery device of FIG. 2.

FIG. 2 is the perspective view schematically showing an example of the recovery device of the inkjet recording apparatus of FIG. 1, FIG. 3 is an exploded perspective view schematically showing an internal structure of the recovery device of FIG. 2, and FIG. 4 is a side view schematically showing a structure of the wiping means and the blade cleaning means of the recovery device of FIG. 2.

In FIGS. 1 to 4, the suction recovery processing can be performed by driving the sucking means 48 while the nozzles are sealed by the capping means 11. In the suction recovery processing, the ink is sucked and ejected forcibly from the nozzles to refresh the ink in the nozzles. That is, the ink whose viscosity is increased, the bubble, and the like are ejected with the ink from the nozzles by the suction recovery processing, which allows the ink ejection performance of the recording head 3 to be maintained and recovered. By capping the recording head 3 with the capping means 11 during non-recording, the drying of the ink in the nozzles can be prevented while the recording head 3 can be protected.

The capping action of the recording head 3 by the capping means 11 is performed at the capping position which is separated by several millimeters away from the home position of the carriage 2. Therefore, the suction recovery processing of the recording head 3 is also performed at the capping position. The reason why the suction recovery processing is performed at the capping position is as follows. Since the capping means 11 also has a function as a pre-ejection drain tray for receiving the ink ejected by the pre-ejection action in the recording frequently, the carriage 2 often abuts on the carriage position control member (abutting portion such as the chassis 9) in the recording action when the capping position corresponds to the home position, which easily results in a decrease in durability or generation of noise.

The wiping means 12 is used for wiping the nozzle surface 23 of the recording head 3 to remove the ink droplets and paper dust which adhere to the nozzle surface 23. The wiping means 12 is disposed near the capping means 11. In the embodiment, when the wiping means 12 wipes the nozzle surface 23 clean, the carriage 2 mounting the recording head 3 is maintained in the state in which the carriage 2 abuts on the carriage position control member 55 formed on the internal surface on the right side of the chassis 9 (in the state in which the carriage 2 is positioned at the home position in the embodiment). At this point, in order to securely perform the positional control of the carriage 2, the carriage drive motor M1 is continuously driven in the direction in which the carriage 2 is pressed against the position control member 55. However, in some cases, the driving of the carriage drive motor M1 can be also stopped during the wiping action after the positioning.

When the nozzle surface 23 of the recording head 3 is wiped clean by a wiper blade 41 (FIG. 4) of the wiping means 12, the ink, the paper dust and the like are transferred onto the wiper blade 41, and sometimes the transferred objects are re-transferred to the recording head 3 by the repetition of the wiping. Since it is necessary to prevent the re-transfer of the ink, the paper dust and the like to the recording head 3 as much as possible, it is required that the wiper blade 41 is cleaned (refreshed) by scraping or wiping the ink and the like which have been transferred to the wiper blade 41. Therefore, the blade cleaning means 18 for cleaning the wiper blade is provided in the recovery device 10 according to the invention. The recovery device 10 of the inkjet recording apparatus 1 of FIG. 1 is configured to maintain and recover the ink ejection performance of the recording head 3 in the normal state by properly combining the capping means 11, the wiping means 12, the blade cleaning means 18, and the suction means 48 (FIGS. 2 to 4).

Figure 5:
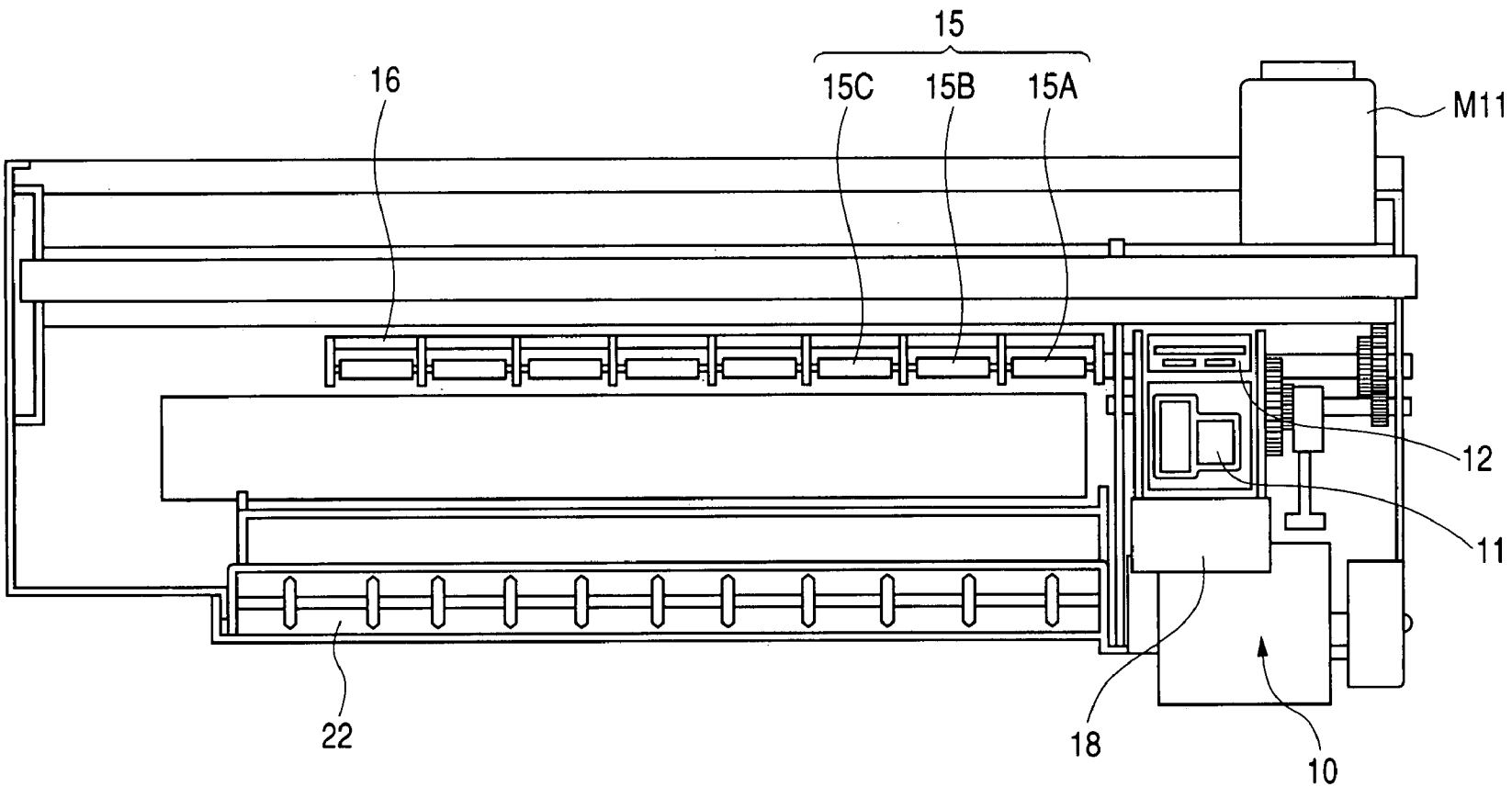
FIG. 5 is a plan view schematically showing a state in which a carriage is located at a capping position in an example of the inkjet recording apparatus to which the invention is applied.
Figure 6:
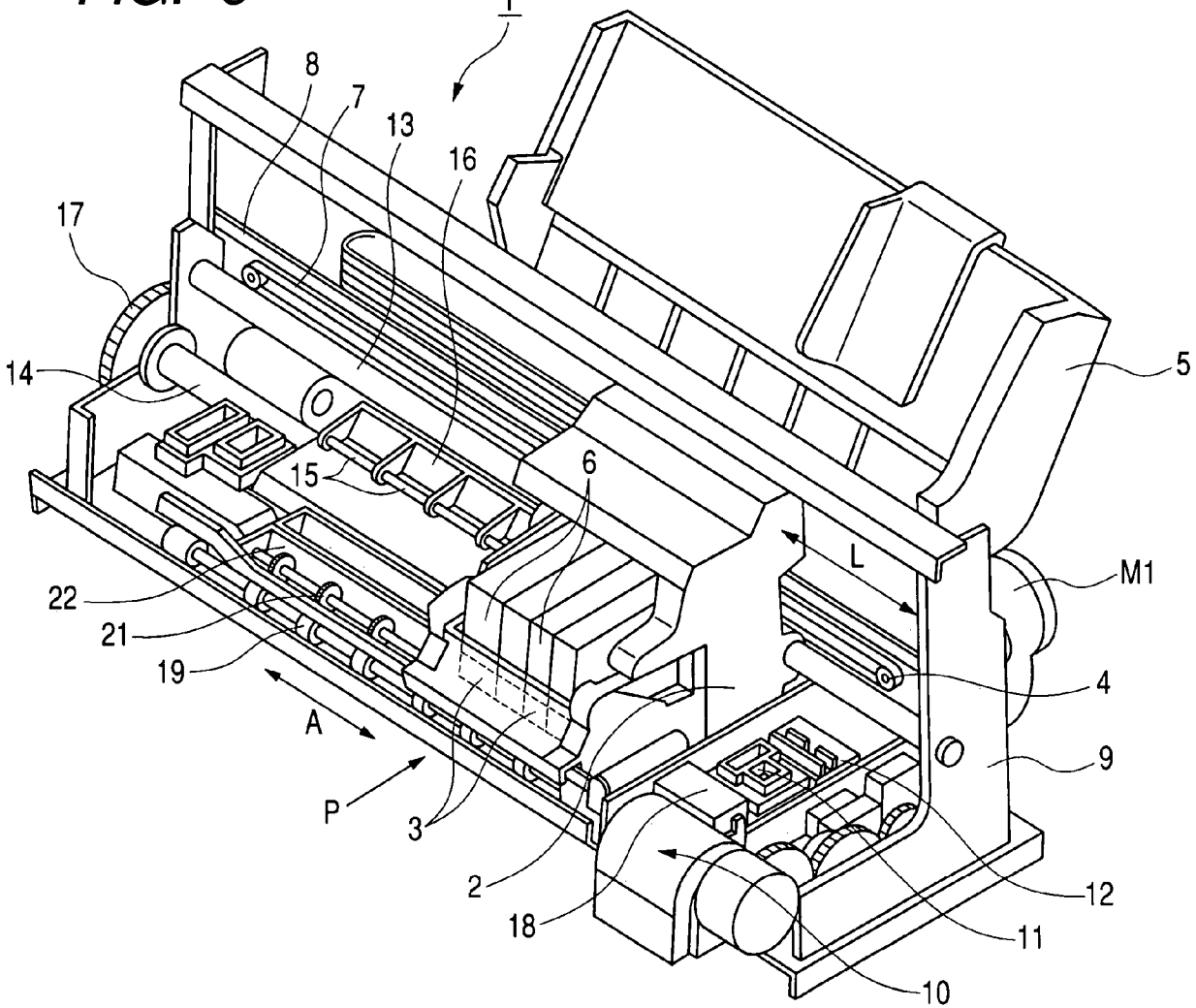
FIG. 6 is a perspective view schematically showing the state in which the carriage is located at a carriage retracting position in an example of the inkjet recording apparatus to which the invention is applied.
Figure 7:
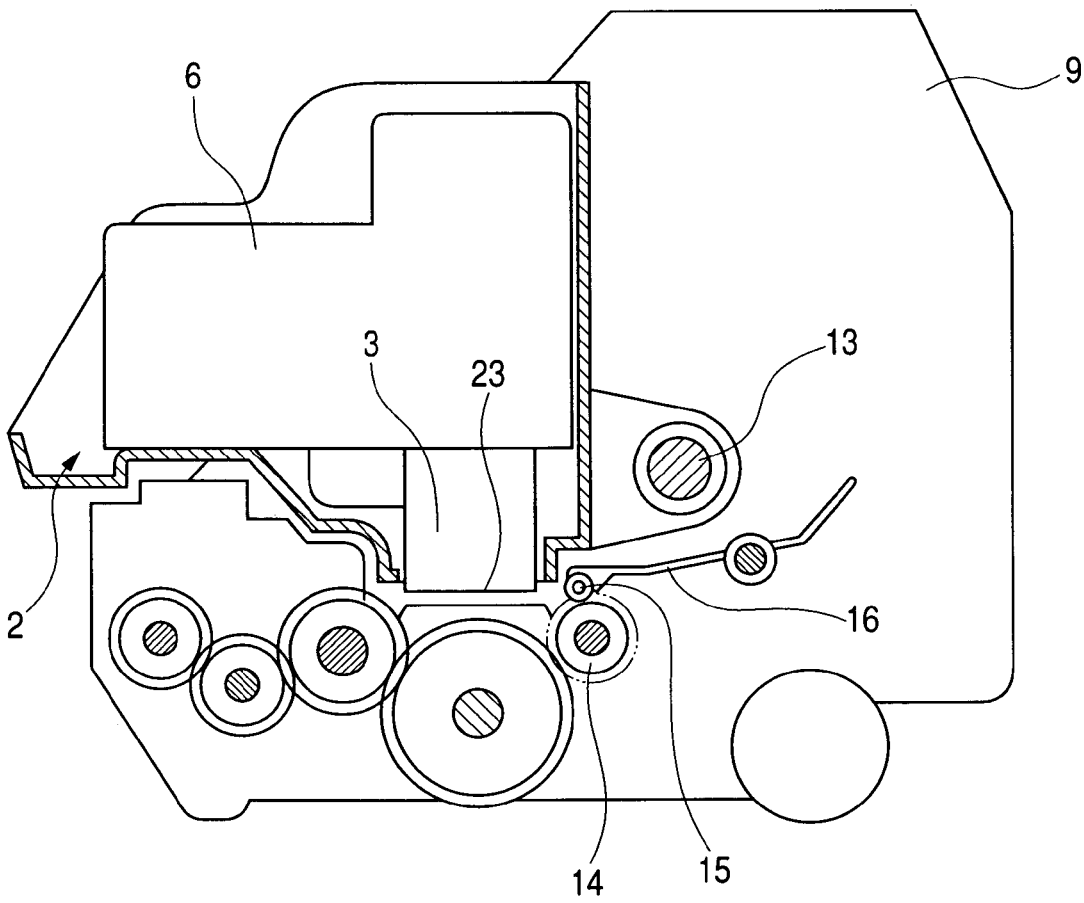
FIG. 7 is a sectional side view schematically showing a positional relationship between the carriage and conveying means in an example of the inkjet recording apparatus to which the invention is applied.

FIG. 5 is a plan view schematically showing the state in which the carriage is located at the capping position in an example of the inkjet recording apparatus to which the invention is applied, FIG. 6 is a perspective view schematically showing the state in which the carriage is located at the carriage retract position in an example of the inkjet recording apparatus to which the invention is applied, and FIG. 7 is a sectional side view schematically showing a positional relationship between the carriage and conveying means in an example of the inkjet recording apparatus to which the invention is applied.

In FIGS. 2 to 4, a tube pump (sucking means) 48 includes two suction tubes 32 and a pressing roller (not shown). The two suction tubes 32 are disposed along the internal surface of an arc portion of a recovery base 20, and the suction tubes 32 use the inside surface of the arc portion as a guide surface. The pressing roller generates negative pressure in the suction tube 32 in such a manner that the pressing roller is rotated so as to squeeze the suction tubes 32 while pressed against the suction tubes 32. The pressing roller is pressed against the suction tubes 32 by a pressing spring (not shown).

The pressing roller is pivotally supported to a pressing roller holder 31 being movable along a long hole-shaped groove formed in the pressing roller holder 31. The pressing roller is biased toward the side on which the suction tube 32 is pressed during the sucking action, and the pressing roller can be retracted from the suction tube 32 except for the case of the sucking action. In the embodiment, two pressing rollers are disposed for one suction tube 32, and four pressing rollers are disposed in total. The pressing roller holder 31 supporting pivotally the pressing rollers is supported pivotally to a pressing roller holder guide 30 while being rotatable in the radial direction of the arc guide surface of the recovery base 20. The pressing roller holder 31 presses the pressing roller against the suction tube 32 and retracts the pressing roller from the pressing roller holder 31. The pressing roller holder guide 30 has shafts at both ends, and is supported pivotally to the same shaft as the arc center of the arc guide surface on which the suction tube 32 of the recovery base 20 is installed additionally. The pressing roller holder guide 30 is rotatably arranged so as to transfer the driving force from a drive motor M3 (hereinafter referred to as PG motor) of the recovery device 10.

The driving force from the PG motor M3 to the sucking means 48 is transferred to a PG gear 24 first and then transferred to a pump gear 27 supported pivotally to the rotating shaft of the pressing roller holder guide 30. The sucking means 48 which is directly connected to a drive shaft of the PG motor M3 performs the sucking action by the rotation of the PG motor M3 in one direction (normal rotation), and performs the operation to separate the pressing roller from the suction tube 32 by the rotation of the PG motor M3 in the reverse direction (reverse rotation). The capping means 11 includes a cap 35, a cap absorber, a cap holder 36, a cap base 34, and a capping means lift lever 37. The cap 35 abuts on the nozzle surface 23 of the recording head 3. The cap absorber absorbs and collects the ink ejected from the nozzles of the recording head 3. The cap holder 36 supports the cap 35 and is biased toward the direction in which the cap 35 is pressed against the nozzle surface 23 by a capping spring (not shown). The cap base 34 supports the cap spring which gives capping pressure to the cap holder 36 and supports the cap holder 36 being slidable in the up and down direction. The capping means lift lever 37 comprises an arm member which abuts the cap 35 on the nozzle surface 23 of the recording head 3 and separates the cap 35 from the nozzle surface 23.

The suction tube 32 of the sucking means 48 is connected to a joint portion provided in the cap holder 36 of the capping means 11. While the cap 35 abuts on the nozzle surface 23 of the recording head 3 (during the capping state), the negative pressure is given to the cap 35 by the sucking action of sucking means 48, which allows the ink to be sucked (ejected) from the nozzles of the recording head 3. In the lifting action to abut the capping means 11 on the recording head 3 (lifting action of the capping means lift lever 37), the driving force of the PG motor M3 is transferred to a one way clutch gear 28 fitted to a cam 38 through PG gears 25 and 26, and the cam 38 performs the lifting action of the capping means 11. The one way clutch gear 28 transfers the driving force from the PG motor M3 to the cam 38 when the one way clutch gear 28 is rotated in one direction, and the one way clutch gear 28 idles not to transfer the driving force to the cam 38 when the one way clutch gear 28 is rotated in the other direction.

In addition to the driving of the capping means 11, the cam 38 is also used for driving the wiping means 12 and for controlling the lifting action of a carriage lock lever 29. The carriage lock lever 29 acts as positioning means for controlling a relative position of the recording head 3 and the capping means 11 during the recovering action by the recovery device 10. The action of each recovering means such as the capping means 11 and the wiping means 12 is performed in such a manner that the rotational positioning of the cam 38 is performed by a cam position detection sensor flag provided in the cam 38 and a cam position detection sensor 40 provided in the recovery device 10, to control each recovering means on the basis of the rotational position of the cam 38.

As shown in FIG. 4, the wiping means 12 includes the wiper blade 41 which wipes the ink adhering to the nozzle surface 23 of the recording head 3, a blade holder 42 which is reciprocated while holding the wiper blade 41, a blade lever gear 44, and blade lever 43. The blade lever gear 44 has a large-diameter gear portion engaging a rack portion of the blade holder 42 and a small-diameter gear portion engaging a PG base rack portion 45 provided in the recovery base 20. The blade lever gear 44 is supported pivotally to the blade lever 43, and the blade lever 43 is linearly moved (parallelly moved) by the end portion of the blade lever 43 being pushed by the rotational movement of the cam 38.

In FIG. 4, when the cam 38 is rotated via the one way clutch gear 28 driven by the PG motor M3, the end portion of the blade lever 43 is pushed by the cam 38 and the blade lever 43 is moved by a predetermined distance in the direction of an arrow F. The movement of the blade lever 43 is accelerated by the blade lever gear 44 and transferred to the blade holder 42. Therefore, the blade holder 42 can be moved for the distance longer than that of the blade lever 43 in the direction of the arrow F. When the cam 38 ends the pushing of the blade lever 43, the blade lever 43 is moved toward a return direction (direction of an arrow B) by the biasing force of a return spring (not shown) while following a cam surface of the cam 38, which makes the blade holder 42 to return to an original position (for example, to the position shown in FIG. 4). The reciprocation movement direction of the blade holder 42 and the movement direction of the carriage 2 intersect each other (orthogonally intersects to each other in the embodiment), so that the direction in which the nozzle surface 23 is wiped by the wiper blade 41 and the movement direction of the carriage 2 also intersect each other.

In the wiping means 12, the nozzle surface 23 of the recording head 3 is wiped by moving the wiper blade 41 toward the direction in which the wiper blade 41 invades or protrudes (direction of the arrow F), and the wiper blade 41 is further moved toward the invasion direction to pass a blade cleaner 47 of the blade cleaning means 18 to clean contamination such as the ink adhering to the wiper blade 41 by the blade cleaner 47. Then, when the drive of the blade holder 42 in the direction of arrow F is stopped in accordance with the rotational movement of the cam 38, the wiper blade 41 passes through the blade cleaner 47 by operation of the return spring (not shown) and is further moved toward the direction of the arrow B to return to the original position shown in FIG. 4.

The blade cleaner 47 is mounted to the blade cleaner holder 46. When the wiper blade 41 is moved toward the invasion direction (direction of the arrow F) to pass the blade cleaner 47, the blade cleaner holder 46 is made to stand still at an interference position to maintain the scraping performance well so that the ink and the like which adhere to the wiper blade 41 are effectively wiped off. On the other hand, when the wiper blade 41 passes through the blade cleaner 47 toward a retracting direction (direction of the arrow B), ink fly-off is suppressed as much as possible by configuring the blade cleaner 47 displacable toward the retracting direction. That is, the blade cleaner 47 is supported pivotally to the blade cleaner holder 46, and the blade cleaner 47 is configured so as to be retracted by rotating the blade cleaner 47 about the support shaft of the rotation when the wiper blade 41 passes through the blade cleaner 47.

Figure 8A:
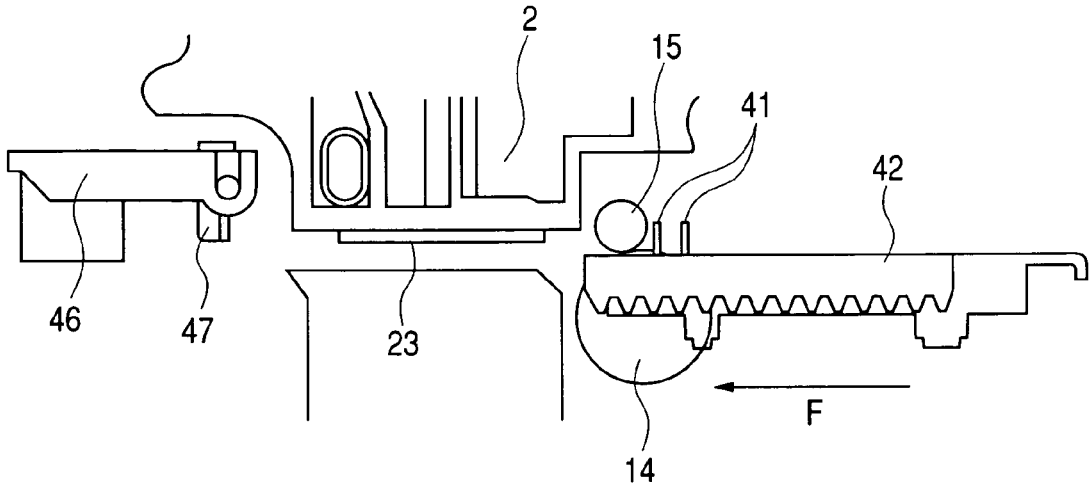
FIGS. 8A, 8B, and 8C are side views schematically showing a wiping action of the wiping means of the inkjet recording apparatus to which the invention is applied in a stepwise manner.
Figure 8B:
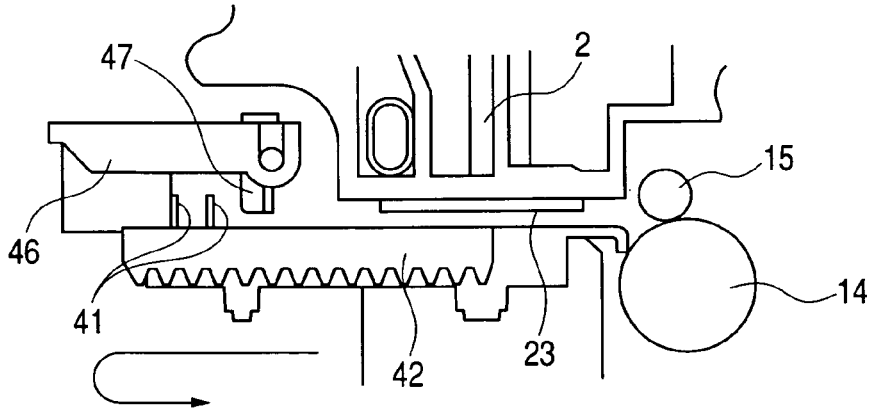
Figure 8C:
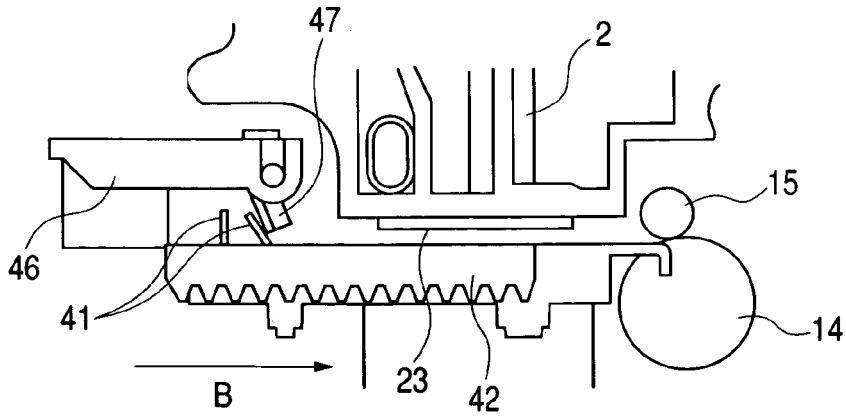
Figure 9:
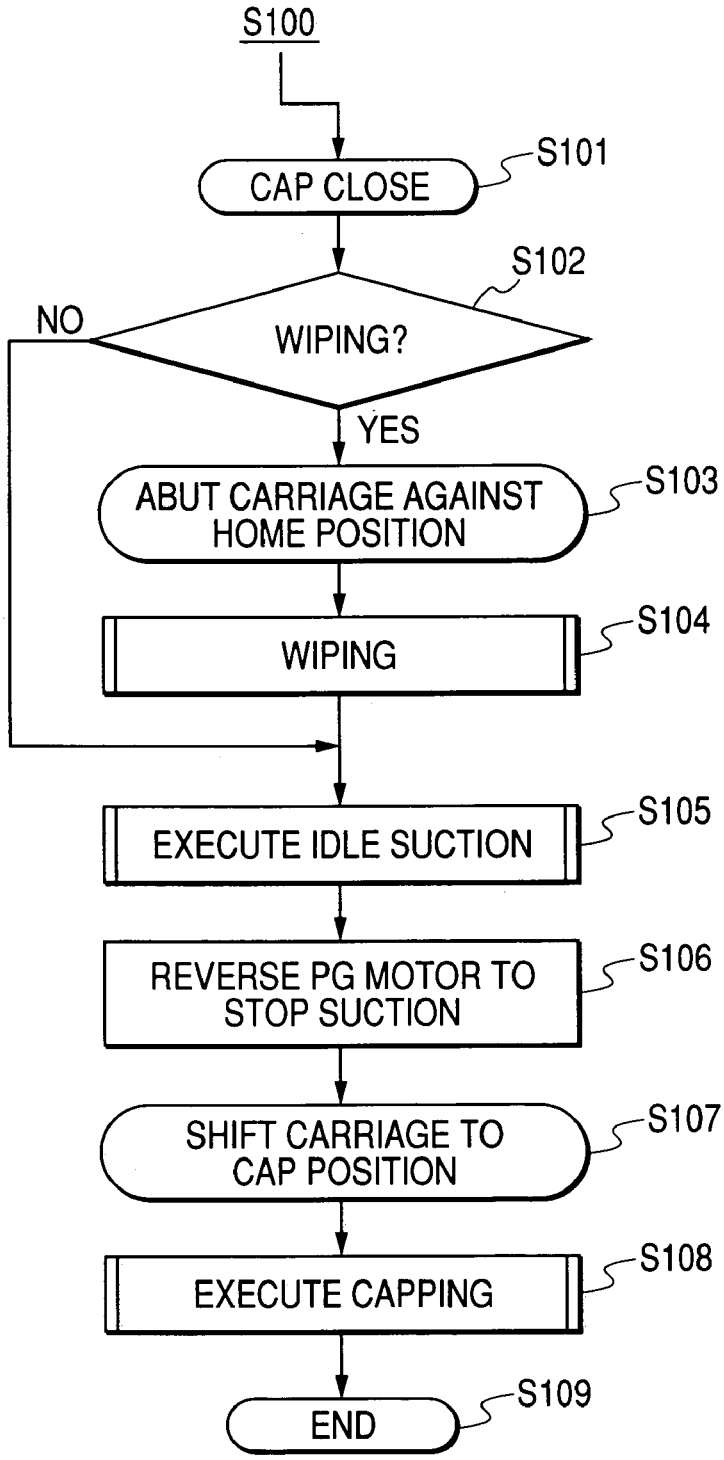
FIG. 9 is a flow chart schematically showing a sequence of a cap closing action in an example of the invention.
Figure 10:
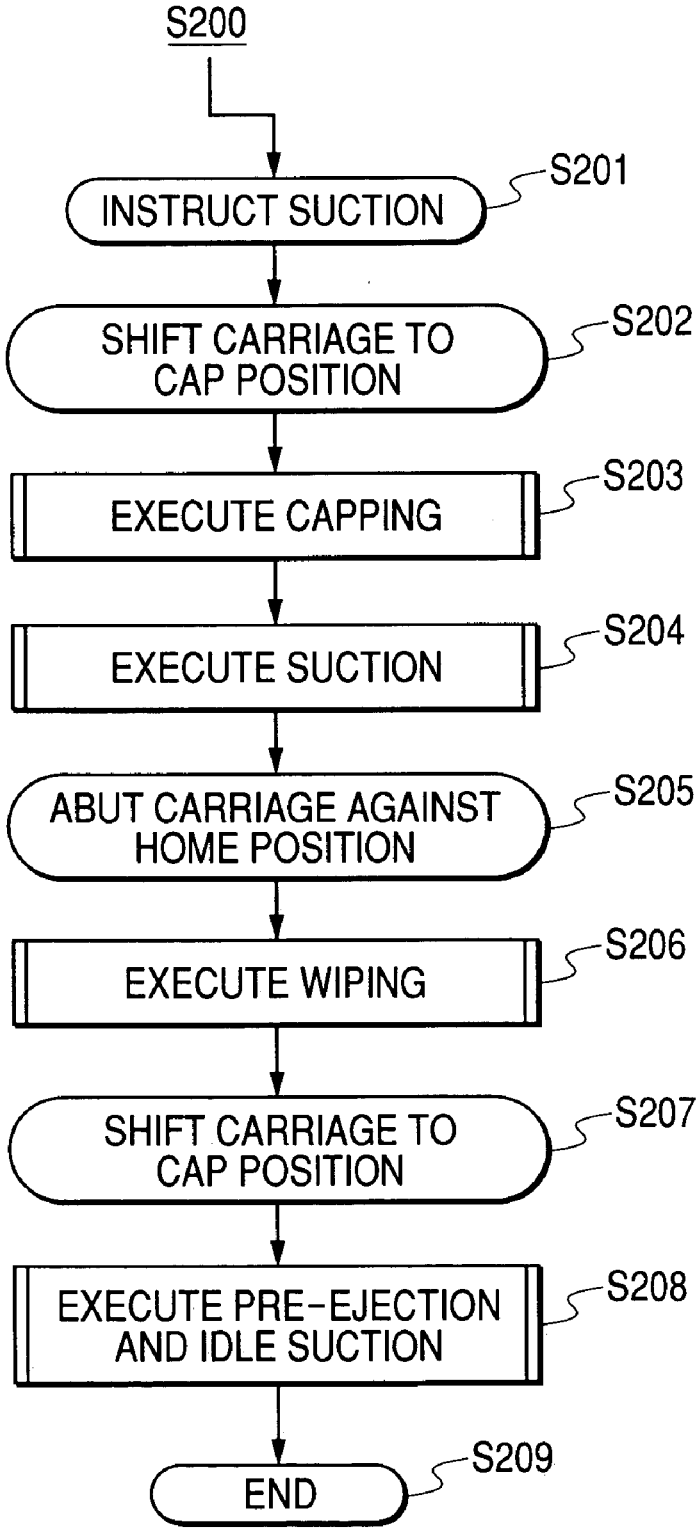
FIG. 10 is a flow chart schematically showing the sequence of a suction recovery action in an example of the invention.
Figure 11:
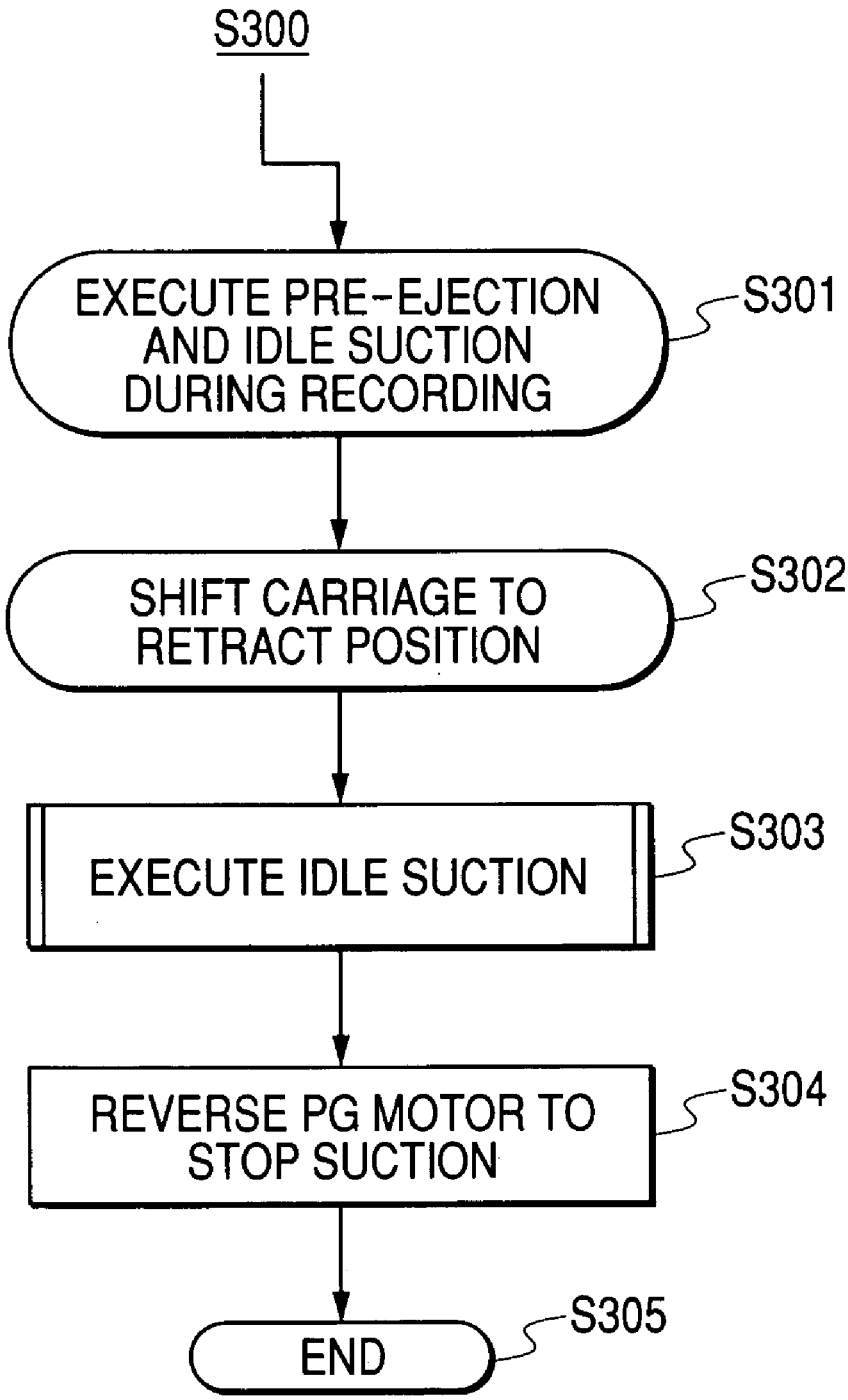
FIG. 11 is a flow chart schematically showing the sequence of pre-ejecting and idle suction action during recording in an example of the invention.
Figure 12:
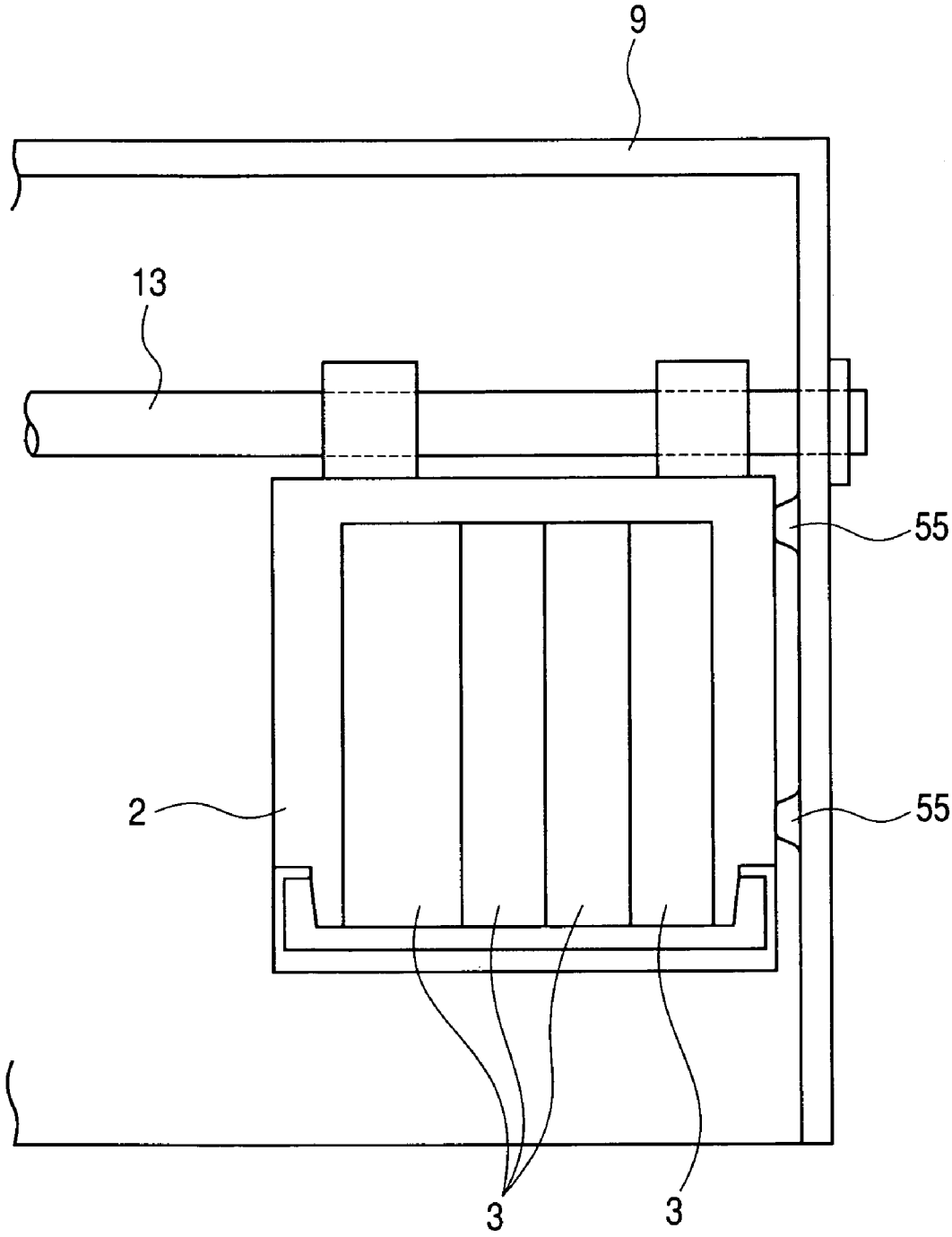
FIG. 12 is a partial plan view showing a carriage position control member for controlling the carriage at a wiping position in the inkjet recording apparatus to which the invention is applied.

FIGS. 8A, 8B, and 8C are side views schematically showing the wiping action of the wiping means of the inkjet recording apparatus to which the invention is applied in a stepwise manner, FIG. 9 is a flow chart schematically showing a sequence of a cap closing action in an example of the invention, FIG. 10 is a flow chart schematically showing the sequence of a suction recovery action in an example of the invention, FIG. 11 is a flow chart schematically showing sequence of pre-ejecting and idle suction action during recording in an example of the invention, and FIG. 12 is a partial plan view showing the carriage position control member for controlling the carriage at the wiping position in the inkjet recording apparatus to which the invention is applied.

The plurality of recovering actions of the recovery device 10 of the inkjet recording apparatus according to the embodiment of the invention will be described referring to FIGS. 1 to 12. When the suction recovery action of the recording head 3 is performed by the recovery device 10, the sequence showing the flow chart of FIG. 10 is performed. The flow chart of FIG. 10 shows a general sucking action S200 of the recovery device 10 in the embodiment. The suction recovery action in the embodiment will be described referring to FIG. 10.

In FIG. 10, when an instruction of the sucking action is provided (Step S201), the position of the cam 38 constituting the recovery device 10 is detected by the cam position detection sensor 40 (FIG. 3), and the positions of the capping means 11 and the wiping means 12 are confirmed. When the recording head 3 is not located at the capping position, after the cam position detection sensor 40 confirms that the capping means 11 and the wiping means 12 are in the state in which the capping means 11 and the wiping means 12 do not interfere with the recording head 3, the driving mechanism 4 of FIG. 1 is driven to move the recording head 3 to the capping position (Step S202). The capping position is also the position where the suction recovery action is performed. In the embodiment, the capping position is set adjacent to the home position (several millimeters inside) provided at the rightmost position in FIG. 1 in the movement range of the carriage 2.

After the carriage is moved to the capping position, capping action is performed in Step S203. That is, in order to perform the suction recovery action at the capping position, the PG motor M3 drives to rotate the cam 38 and the capping means 11 makes the cap 35 to abut on the nozzle surface 23, to seal the nozzles (Step S203). Then, the PG motor M3 is rotated in the direction of the sucking action, i.e. the PG motor M3 is rotated in the direction in which the driving force is transferred onto the side of the sucking means 48, and the suction recovery action for sucking a predetermined amount of ink is performed (Step S204). After the sucking action (Step S204) is performed to retract the capping means 11 from the recording head 3, the carriage 2 is moved to the home position to abut on the carriage position control member 55 (FIG. 12) (Step S205).

While the carriage 2 is positioned and stopped by abutting on the carriage position control member 55, the wiping means 12 wipes the nozzle surface 23 (Step S206). That is, in Step S206, after the carriage 2 is moved toward the home position to abut on the carriage position control member 55 formed on the internal surface on the right side of the chassis 9 in FIG. 1, and the carriage 2 is positioned and stopped at the home position which is the reference position of the carriage movement, then the wiping action is performed. In this case, it is preferable to more securely position the carriage 2 by continuously pressing (abutting) the carriage 2 against the carriage position control member 55 during wiping the nozzle surface 23 clean.

As shown in FIG. 12, although the carriage position control member 55 is disposed on the internal surface on the right side of the chassis 9 in the embodiment, as long as the carriage position control member is one which positions and stops the carriage 2 at the setting position, other proper members fixed to the predetermined position can be selected as the carriage position control member. The nozzle surface 23 is wiped clean (wiping action) by driving the wiping means 12 by the PG motor M3 after abutting the carriage 2 on the carriage position control member 55 (Step S206).

The wiping action and the blade cleaning action in Step S206 will be described referring to FIGS. 8A, 8B, and 8C. In FIGS. 8A, 8B, and 8C, in the wiping action of Step S206, the wiper blade 41 is moved in the direction intersecting with (normally orthogonal to) the carriage movement direction (direction of the double-headed arrow A in FIG. 6) in order to wipe the ink adhering to the nozzle surface 23 of the recording head 3. After the nozzle surface 23 is wiped clean by the wiper blade 41, the ink transferred to the wiper blade 41 is scraped by the blade cleaner 47 in such a manner that the wiper blade 41 is made to invade into the blade cleaner 47.

Then, the movement direction of the wiper blade 41 is reversed by driving the PG motor M3, the wiper blade 41 is moved toward the wiping means retracting direction (direction of the arrow B) to return to the original position, then the wiping action is finished. Until the movement of the wiper blade 41 toward the invasion direction (direction of the arrow F) is finished, the wiping action and the blade cleaning action are performed while the carriage 2 abuts on the carriage position control member 55 formed on the internal surface on the right side of the chassis 9 (FIG. 12).

In the case where the wiping action is performed, in order to prevent the carriage 2 from coming into contact with the unnecessary point of the recording head 3 when the wiper blade 41 is moved toward the retracting direction (return direction, the direction of the arrow B), the carriage 2 is previously moved and stopped at the carriage retracting position until the wiper blade 41 returns to the original position. The carriage retracting position is located adjacent to the recovery device 10. For example, the carriage retracting position is set at a position P, distance L away from the suction recovery position (or the home position) selected directly above the recovery device 10 toward the inside of the main body of the apparatus (for example, about 60 mm away from the suction recovery position toward the opposite side of the reference side).

After the wiping action is finished, the carriage 2 (recording head 3) is moved to the suction recovery position to perform the pre-ejection for ejecting the color mixture ink which may have intruded into the nozzles of the recording head 3 during the sucking action and the wiping action. Since the pre-ejection is performed at the suction recovery position in the embodiment, the pre-ejection is performed in such a manner that the ink is ejected from the nozzle into the cap 35 with the cap opened. After the pre-ejection is finished, the waste ink which has accumulated in the cap 35 is drained by an idle suction action. The draining of the ink by the idle suction is performed by driving the sucking means 48 driven by the PG motor M3 in the direction in which the suction recovery action is performed so that the waste ink in the cap 35 is sucked and drained through the suction tube 32 connected to the cap 35. The pre-ejection and idle suction action (Step S208 in FIG. 10) is performed, and the general suction recovery action is finished (Step S200 in FIG. 10).

At the time when the suction recovery action or the pre-ejection and idle suction action is finished, because the sucking action performed by the sucking means (suction pump) 48 is released while the pressing roller is pressed against the suction tube 32, the pressing roller is rotatedly driven by the PG motor M3 in the direction in which the sucking action is released, and the action in which the pressing roller is separated from the suction tube 32 is performed (Step S304 in FIG. 11). Although the pre-ejection and idle suction action is performed at the capping position in the embodiment, in some cases it is also possible that the pre-ejection and idle suction action is performed at another position. In this case, it is necessary that the pre-ejection tray for receiving the ink ejected from the pre-ejection action is arranged at another position (for example, the carriage retracting position shown in FIG. 6) and the sucking means is connected to the pre-ejection tray.

The cap closing action in the embodiment will be described referring to FIG. 9. In FIG. 9, when the instruction for closing the cap is provided (Step S101), in accordance with the state of the nozzle surface 23 of the recording head 3, a CPU (not shown) decides whether the wiping action is performed or not (Step S102), and the wiping action is performed if necessary (Step S104). Similarly to the general sucking action, the wiping action is performed while the carriage 2 is moved toward the home position to abut on the carriage position control member 55 formed on the internal surface on the right side of the chassis 9. In wiping the nozzle surface 23 clean, it is preferable to more securely position the carriage 2 by driving the carriage 2 to be pressed against the carriage position control member 55.

After the wiping action is performed, the idle suction action for draining the waste ink accumulated in the cap 35 by the pre-ejection and the like in the recording is performed (Step S105). The idle suction action is performed in the same manner as the idle suction action in the pre-ejection and idle suction action (Step S208). Then, in Step S106, while the sucking action is stopped by reversely rotating the PG motor M3, the wiper blade 41 is retracted and moved to return to the original position. That is, in order to release the pressing roller 33 from the suction tube 32 of the sucking means 48, the pressing releasing action of the pressing roller 33 is performed by the reverse rotation of the PG motor M3.

The carriage 2 is previously moved to the carriage retracting position P shown in FIG. 6. Then, the carriage 2 is moved to the capping position (Step S107), and the capping action in which the cap 35 abuts on the recording head 3 mounted on the carriage 2 to cover the nozzles is performed at the capping position (Step S108 in FIG. 9). Therefore the sequence of cap closing action is finished (Step S109).

The pre-ejection and idle suction action in the recording (Step S300) in the embodiment will be described referring to FIG. 11. In FIG. 11, when an instruction of the pre-ejection and idle suction is provided in the recording (Step S301), the carriage 2 is moved to the carriage retracting position P (FIG. 6) (Step S302), and the idle suction action for draining the waste ink accumulated in the cap 35 by the pre-ejection in the recording is performed (Step S303). Similar to the idle suction actions in the suction recovery action (Step S200 of FIG. 10) and the cap closing action (Step S100 of FIG. 9), the idle suction action (Step S303) is performed by the operation of the sucking means (suction pump) 48 connected to the cap 35.

After the idle suction action (Step S303), the pressing releasing action of the pressing roller is performed by the reverse rotation of the PG motor M3, and the pressing roller is separated from the suction tube 32 of the sucking means 48 to be in the pressing releasing state (Step S304). Then the cap 35 is returned to the same position as the position immediately before performing the pre-ejection and idle suction action in the recording (Step S300), and the sequence of the pre-ejection and idle suction action is finished (Step S305).

As can be seen from the above descriptions, according to the embodiments of the invention, the inkjet recording apparatus in which the carriage can be stopped automatically and accurately at the wiping position and the wiping and cleaning of the nozzle surface of the recording means are accurately performed independently of the accuracy of the carriage stop action is provided.

What is claimed is:

1. An inkjet recording apparatus, comprising:

a carriage which is moved while mounting a recording head for recording on a material to be recorded by ejecting ink;

a conveying roller which conveys the material to a position opposite to the recording head;

a chassis which rotatably holds said conveying roller;

a guide shaft, positionally fixed to said chassis, to slidably support said carriage;

a DC motor which drives said carriage;

a code strip arranged parallel to said guide shaft, said code strip indicating a position of said carriage;

a regulating member positionally fixed to an internal surface of said chassis, said regulating member being arranged at an end in a movement range of said carriage, to regulate the movement of said carriage and become a home position of the carriage movement by the abutment of said carriage on said regulating member; and a wiping member which wipes a nozzle surface of the recording head;

a second motor which drives said wiping member; and control means which executes such a control that while said DC motor is driven to press said carriage against said regulating member, said second motor is driven to cause said wiping member to wipe the nozzle surface of the recording head.

2. An inkjet recording apparatus according to claim 1, wherein said wiping member comprises a wiper blade which is moved in a direction crossing a movement direction of said carriage.

3. An inkjet recording apparatus according to claim 1, further comprising a capping member which covers nozzles of the recording head, wherein a position where said wiping member wipes the nozzle surface clean is different from a position where the nozzles are covered by said capping member, relative to a movement direction of said carriage.

4. An inkjet recording apparatus according to claim 1, wherein a position where said wiping member wipes the nozzle surface clean is different from a position where the recording head performs pre-ejection, relative to a movement direction of said carriage.

* * * * *